United States Patent [19]

Quance

[11] 4,242,813

[45] Jan. 6, 1981

[54] SKI EQUIPMENT TRANSPORT AND SECURITY METHOD AND APPARATUS

[76] Inventor: Raymond P. Quance, 5509 Mason Dr., Fort Wayne, Ind. 46809

[21] Appl. No.: 18,630

[22] Filed: Mar. 8, 1979

[51] Int. Cl.[3] ..... A43D 5/00; A45C 0/00; A43B 5/00

[52] U.S. Cl. ..... 36/132; 12/120.5; 224/45 S

[58] Field of Search ..... 36/1, 117, 132, 136; 12/120.5; 224/45 S, 49, 257, 917

[56] References Cited

U.S. PATENT DOCUMENTS

| | | | |
|---|---|---|---|
| 3,259,284 | 7/1966 | Olson | 12/120.5 |
| 3,587,951 | 6/1971 | Derouin | 224/45 S |
| 3,653,565 | 4/1972 | McAusland | 224/45 S |

FOREIGN PATENT DOCUMENTS

| | | | |
|---|---|---|---|
| 2310112 | 3/1976 | France | 36/1 |

*Primary Examiner*—Patrick D. Lawson
*Attorney, Agent, or Firm*—Gust, Irish, Jeffers & Hoffman

[57] ABSTRACT

A resilient, compressible, spherical member is attached to each end of an elongated, flexible strap. Each member is dimensioned for close fitting emplacement in a ski boot after which a boot clamp is fastened to removably retain the member in the boot. Thus clamped, the strap may be slung over the user's shoulder, with a boot at either strap end, for boot transport. In a modification, the strap may be looped over a ski rack and a lock is provided between the members. A flexible elongated band is dimensioned lengthwise to fit snugly about ski equipment, such as a pair of skis and ski poles, and is provided at its ends with eyelets for locking engagement with the lock whereby the equipment may be locked to the rack.

14 Claims, 10 Drawing Figures

SKI EQUIPMENT TRANSPORT AND SECURITY METHOD AND APPARATUS

BACKGROUND OF THE INVENTION

1. Field of the Invention

This invention relates to ski boot transport devices and ski equipment security devices and more particularly to a boot carrier having a strap for placement in carrying position on the user's shoulder.

2. Description of the Prior Art

Skiing, while a very early mode of transportation and sport form, has recently gained immense popularity. Ski equipment, especially during recent years, has seen significant change. One of the changes is the advent of a relatively hard inflexible ski boot which, while providing certain advantages over the more flexible, supple leather boot, has made walking, for any distance impractical and uncomfortable. Therefore, it is desirable to carry the boots as well as the ski equipment, such as skis and ski poles.

While boot carriers are well known to the art, they are generally hand carried which is difficult and cumbersome when other ski equipment is also to be carried. Several attempts have been made to relieve the necessity of such hand carrying, exemplified by the devices disclosed in U.S. Pat. Nos. 3,259,284 and 3,587,951, which disclose devices to be worn on the shoulder for transporting the boots. However, such devices involve attachment of the carrying member to the boot sole, requiring an adjustable member to accommodate various boot sizes. Thus, not only is the cost of the device increased, but there is a user need for adjusting the device to the boot size.

Further, devices are known for securing ski equipment, such as skis and ski poles, to a ski rack adjacent to the ski area during periods of skier rest and refreshment. While such security devices are known in the art, they are separate from and in addition to devices for ski equipment and ski boot transport. This adds to equipment expense and equipment bulk, making transport inconvenient.

SUMMARY OF THE INVENTION

A voluminal member, such as a ball, which may be resiliently compressible is dimensioned for close fitting emplacement into a ski boot, with a member connected to each end of an elongated carrying strap. After placing each member into a boot, the boot clamps are fastened to constrict the upper portion of the boot. The strip may then be slung over the user's shoulder and the boots may be transported, leaving the user's hands free. The connection between the members and the boots is quickly and easily made with any size boot. Adjustment of member size to boot size is unnecessary. The resiliency of the member and the restriction of the closed ski boot clamp provides automatic adjustment to a wide range of boot sizes.

In one embodiment of this invention, the boot carrier is combined with a ski equipment security lock. Each member is provided with a cooperating lock device, which, after looping the strap around a ski rack or other fixed object, the devices may be locked together. Also provided, is a band which is adapted to be snugly looped around ski equipment, such as skis and ski poles, and has eyelets formed at each end thereof through which are placed a cooperating lock device. Thus, with the addition of but a single band, the boot carrier may be converted into a ski equipment security device.

In the method of this invention, an elongated strap provided with voluminal members secured to each end thereof; the steps of the method comprise inserting a first voluminal member in close-fitting engagement into a first unclamped ski boot, inserting a second voluminal member in close-fitting engagement into a second unclamped ski boot, constricting the upper portions of the first and second boots to releasably retain the members in the boots, and slinging the strap over the user's shoulder.

Therefore, it is an object of this invention to provide a ski boot carrier that is low in cost and quickly and easily attachable to a variety of boot sizes without adjustment.

A further object of this invention is to provide a combination ski boot carrier and ski equipment security device.

Another object of this invention is to provide a method of ski boot transport that is relatively simple and easily performed.

The above mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENTS

Figure 1:
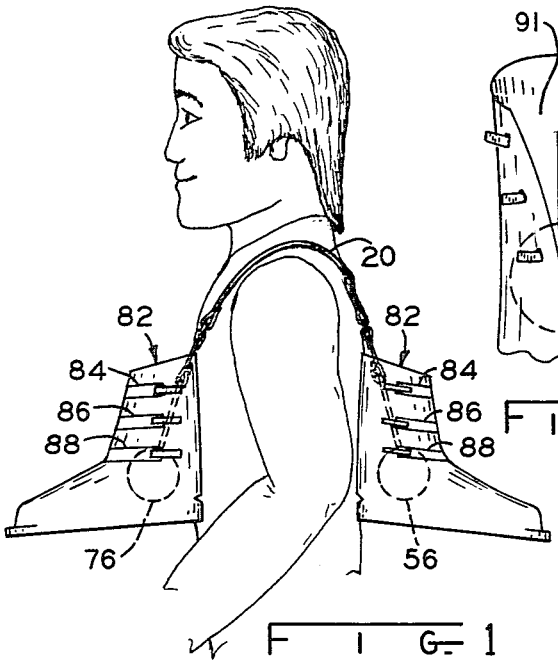
FIG. 1 is a side elevational view of an embodiment of this invention shown in the transport position.

Referring to the drawings, FIGS. 1–5, an elongated flexible strap 20, which may be made of a braided fabric having a plastic or leather backing which may have ornamental designs thereon, is shown. An adjustment slide 26, of conventional design, has a center strut 28 and elongated openings 30,32. Strap end 24 is inserted through opening 32 and folded back upon itself and securely attached as by sewing or riveting so that strut 28 is loosely secured to end 24. Strap end 22 is then threaded through elongated opening 34 of frame connector 36, opening 32, opening 30, and elongated opening 38 of frame connector 40 after which it is folded over upon itself and secured to strap 20 as by sewing or riveting to loosely secure connector 40 thereto. As will be appreciated, the length of strap 20 may thus be adjusted by moving slide 26 longitudinally of strap 20.

A tapered flexible end portion 42 is threaded through opening 34 and has a tab 44 formed at the end thereof which is threaded through the opening of eye 46 formed at one end of elongated rod 48, tab 44 being folded over upon portion 42 and secured thereto as by rivet 50, thus loosely securing eye 46 to portion 42. Rod 48 is inserted through a washer 52, a diametral opening 54 in a voluminal spherical member 56, which is preferably of a compressible, resilient, material, through washer 58 and is secured at its other end, as by threaded engagement, with nut 60 to secure member 56 to rod 48.

A tapered flexible portion 62 is threaded through opening 38 and has a tab 64 inserted through the opening of eye 66 formed at one end of an elongated rod 68, with tab 64 being folded over portion 62 and secured thereto as by rivet 70. Rod 68 is inserted through a washer 72, an elongated diametral opening 74 in a voluminal spherical member 76, which is preferably of a compressible, resilient material, through washer 78, with the other end of the rod 68 being secured, as by threaded engagement, with nut 80 thus securing member 76 to rod 68.

Figure 2:
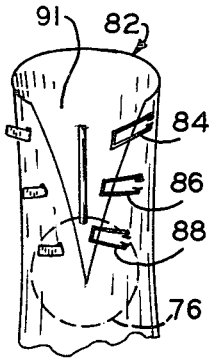
FIG. 2 is a partial front elevational view of an unclamped boot having a strap end attached voluminal member inserted therein.
Figure 3:
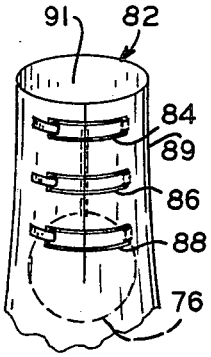
FIG. 3 is a view similar to FIG. 2 wherein the boot is clamped.
Figure 3A:
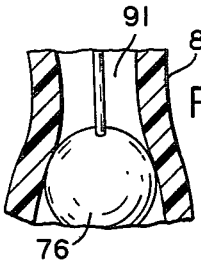
FIG. 3A is a sectional view of the clamped boot of FIG. 3.
Figure 4:
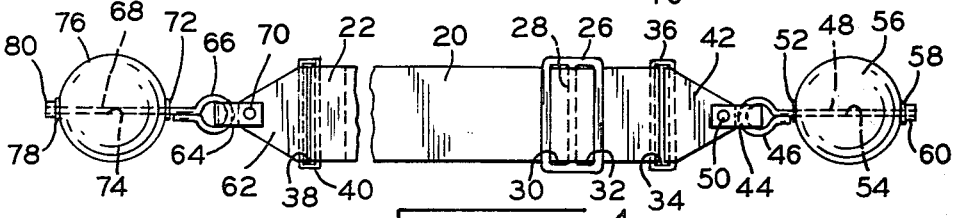
FIG. 4 is a top elevational view to the transport embodiment shown in FIGS. 1–3.
Figure 5:
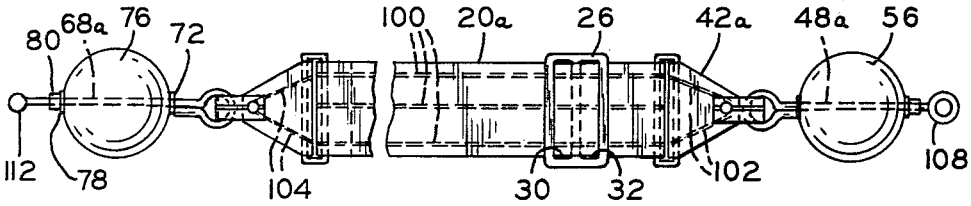
FIG. 5 is a top plan view of a second embodiment of this invention showing a transport device having locking devices at the ends thereof.
Figure 6:
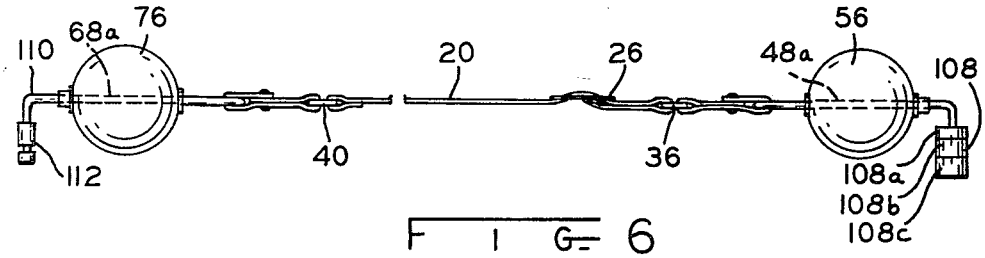
FIG. 6 is a side elevational view of the embodiment of FIG. 5.

In the operation of the embodiment of FIGS. 1–4, a ski boot 82 having clamps 84, 86, 88 of conventional design arranged in spaced relation at the boot upper portion 89 in conventional manner, is in an unclamped position, FIG. 2, with member 76 manually inserted therein to a position below uppermost clamp 84. Then clamp 84 is fastened in a clamped condition, FIGS. 3 and 3A to constrict the boot upper portion such that the opening 91 which accommodates the skier's leg in use is smaller than the diameter of member 76 so as to releasably retain member 76 in boot 82. Member 76 is dimensioned to closely fit the interior of boot 82 so that upon fastening of clamp 84 it will be held in a boot retained position. In similar manner, member 56 is retained in the other boot. Strap 20 is longitudinally adjusted for user preference and then slung over the user's shoulder for hand-free boot transport, FIG. 1. Members 56, 76 may be readily removed from their respective boots by simply unfastening the uppermost clamp members and withdrawing the members therefrom. Due to the compressible resilient nature of members 56, 76, they are self-adjusting to a variety of boot sizes, making unnecessary any manual adjustment.

It should be noted that the present invention is useful with boots regardless of the means whereby the upper portion of the boot is constricted, and is not limited to the over-center toggle-type clamps shown in the present application. For example, a ski boot which laces up would work equally well, because all that is necessary is that the upper portion of the boot be constricted to reduce the opening 91 smaller than members 56 and 76.

Referring to FIGS. 5–9, a strap **20*a* is provided with certain similar components as in the embodiment as shown in FIGS. 1–4, with the similar components carrying similar reference numerals. Strap 20*a* has formed there sever-resistant cords 100, 102, 104, which cords may be of a flexible metallic composition. Portions 42*a*, 62*a*, tabs 44*a* and 64*a* are also provided with sever-resistant cords 102, 104, 102*a* and 104*a* respectively and rod 48*a* at its other end is extended and formed with a right angle bend 106 at the end of which is a conventional cylinder lock 108 having rotatable cylinder portions 108*a*, 108*b*, and 108*c*. Also, rod 68*a* is extended and is formed at its other end with a right angle bend 110 and at the end thereof is a cooperating lock insert 112 which is insertable in lock 108 for lockable engagement. Cylinder lock 108 lockably receives device 112 and upon the proper alignment of the rotatable cylinder portions, releases device 112 therefrom. Other cooperating locking devices well known to the art can be used at the ends of rods 48*a* and 68*a***.

Figure 7:
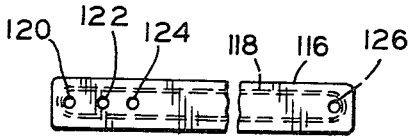
FIG. 7 is a top plan view of a security band.

An elongated flexible band 116, FIG. 7, has formed therein a sever-resistant cord 118 and which also may be of a flexible metallic material, cord 118 enclosing eyelets 120, 122, 124 at one end of band 116 and eyelet 126 at the other end of band 116. Band 116 is longitudinally dimensioned to be snugly looped about ski equipment, such as skis 130, 132, FIGS. 8 and 9, and/or ski poles, not shown. Slide 26, connectors 36, 40, rods **48, 68, 48*a*, 68*a* and nuts 60, 80** are preferably of a metallic material.

Figure 8:
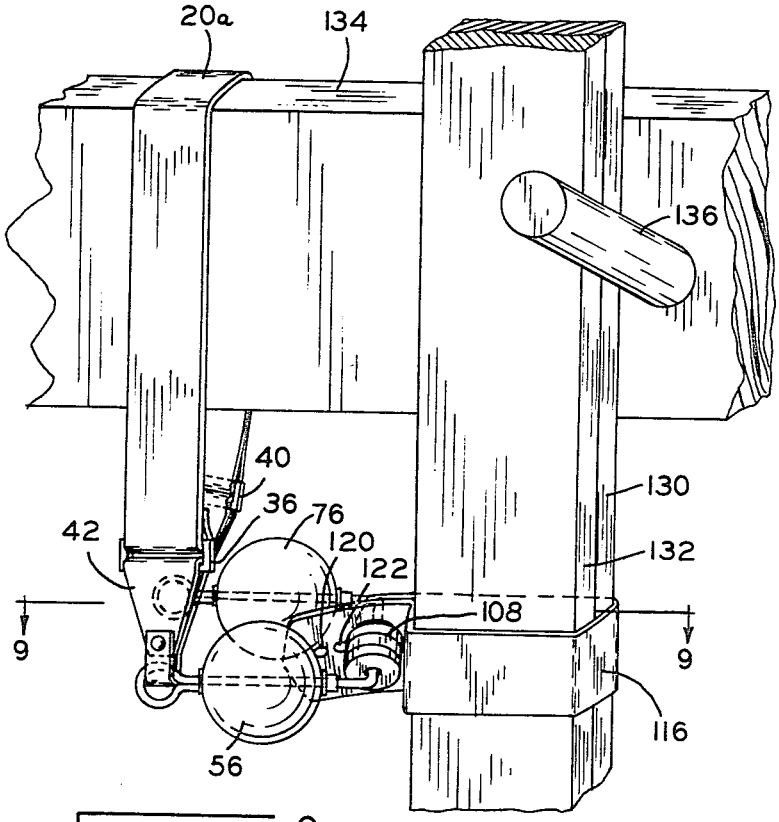
FIG. 8 is a perspective view of the embodiment of FIGS. 5 and 6 in combination with a ski equipment band of FIG. 7, shown in a secured condition.
Figure 9:
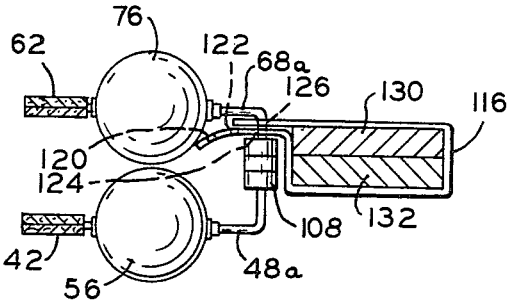
FIG. 9 is a section taken at 9—9 of FIG. 8.

In the operation of the embodiment shown in FIGS. 5–9, strap **20*a* is looped about a ski rack 134, FIG. 8, and skis 130, 132 are placed in supported relation against rack 134 and peg 136 extending laterally from rack 134. Rack 134 and peg 136 are conventional ski supports but it is to be understood that strap 20*a* may also be looped around any fixed object such as a vertical pole, tree, or other suitable object. Band 116 is then placed around skis 130, 132 and device 112 is inserted through eyelet 126 and the proper eyelet 120, 122, 124 to achieve a snug fit about skis 130, 132. Device 112 is then inserted into lock 108 and the lock cylinders 108*a*, 108*b* and 108*c* are rotated to lock device 112 in lock 108. Due to the snug fit of band 116 about skis 130, 132, they are effectively held against removal therefrom since skis are considerably elongated and any effort at their removal would be time consuming and quite obvious as a theft attempt. Further, the inner surface of band 116, that surface contiguous with skis 130, 132, can be made of an anti-slip material to further resist sliding movement of the skis in a removal attempt. When it is desired to remove band 116 from the skis, lock cylinders 108, 108*b*, and 108*c* are rotated until the lock combination is aligned with an index mark and device 112 may be romoved from lock 108 and band 116 unwrapped from skis 130, 132. Thus, the embodiment of FIGS. 5–9 can be used as a boot transport device, as described for the embodiment of FIGS. 1–4, since the addition of the lock 108 and lock device 112 will not interfere therewith, and with the addition of but a single member, band 116**, a ski equipment security device is provided.

In the method of this invention, a first member 56 is placed in an unclamped, open boot 82 after which the boot is clamped to releasably retain the member therein, a second member 76 is placed in unclamped boot 83 after which this boot is clamped to releasably retain the member therein, and an intermediate portion of strap 20 is slung over the user's shoulder to suspend the boots 82, 83 in balanced support on either side of the user's shoulder for transport of the boots.

While there have been described above the principles of this invention in connection with specific apparatus, it is to be clearly understood that this description is made only by way of example and not as a limitation to the scope of the invention.

What is claimed is:

1. Transport apparatus for a pair of ski boots each boot having an inner space adapted to receive the foot of the wearer of the boot and having an upper portion with an opening therein adapted to receive the leg of the wearer of the boot and including means for selectively constricting the opening when the boot is worn, said transport apparatus comprising: a pair of voluminal members dimensioned to be inserted through the openings and into the inner spaces of the respective boots when the openings are in their unconstricted states, and to be in close fitting emplacement within the boot inner spaces and securely retained therein when the boot openings are constricted, and an elongated, flexible carrying support secured to said voluminal members at spaced apart locations on said carrying support.

2. The apparatus of claim 1 wherein said support is a strap.

3. The apparatus of claim 1 wherein the length of said support is dimensioned so that said support may be slung over the user's shoulder for boot transport.

4. The apparatus of claim 3 including a pair of ski boots each having a clamp having a first released position and a second clamped position; and a said member being emplaced in each of said boots said clamps being in said second positions to clampably and releasably retain said members in said boots.

5. The apparatus of claim 1 including means for adjusting the length of said support.

6. Transport apparatus for ski boots each having a clampable boot fastening comprising:

a pair of voluminal members dimensioned for close-fitting emplacement into ski boots and retainably clampable in said emplaced position, said voluminal members being spherical and made of a resilient compressible material; and an elongated carrying support secured at opposite ends to respective said members, said support comprising a flexible strap.

7. Transport apparatus for ski boots each having a clampable boot fastening comprising:

a pair of voluminal members dimensioned for close-fitting emplacement into ski boots and retainably clampable in said emplaced position;

an elongated carrying support secured at opposite ends to respective said members, said support being a flexible strap having a length dimensioned so that the strap may be slung over the user's shoulder for boot transport;

a flexible, elongated band longitudinally dimensioned to fit snugly around ski equipment;

locking means secured to said members for releasably locking said members together, the ends of said band being lockably engagable with said locking means so that after said band is snugly looped around the ski equipment and said strap is looped around a fixed object, the band and strap can be locked in their respective looped positions;

said band and strap being sever-resistant.

8. The apparatus of claim 7 including an elongated rod inserted through each of said members;

means for attaching one end of each of said rods to respective ends of said strap;

the other end of one of said rods carrying a lock device; the other end of the other of said rods being releasably lockable to said lock device; and each of said band ends having means for securably and removably receiving said other ends of said rods prior to locking of said locking device and after looping about said ski equipment.

9. The apparatus of claim 8 wherein said other rod ends are formed with a substantially right angle bend to facilitate locking engagement of said ends.

10. In combination with a pair of boots each having an upper portion with an opening therein adapted to receive the leg of a user when the boot is worn on the foot of a user, and securing means on the upper portion of each boot for constricting the respective opening, a transport apparatus for the boots comprising: a pair of voluminal members connected together by means of a flexible, elongated strap means, said voluminal members being disposed in respective said boots and retained therein by the constricting of said openings, said strap means extending out of said boots through said openings.

11. The combination of claim 10 wherein said securing means comprise over-center type clamps on said boot upper portions.

12. The method of transporting ski boots with a flexible, elongated strap having a voluminal member at each end thereof comprising the steps of:

placing a first voluminal member into a first boot and clamping the boot to releasably retain the voluminal member therein, placing a second voluminal member into a second boot and clamping the second boot to releasably retain the voluminal member therein, supporting an intermediate portion of the strap on a body portion of the user whereby the boots will be suspended in balanced support on opposite sides, respectively, of the body portion for transport of the boots.

13. The method of claim 12 wherein the boots include upper portions having respective openings therein adapted to receive the leg of the user when the boots are worn, and wherein the voluminal members are clamped in the boots by constricting the openings in the upper portions thereof.

14. The method of claim 12 wherein said last step comprises placing the intermediate portion of the flexible strap over the user's shoulder whereby a boot will be suspended from and on each side of the shoulder of the user.

* * * * *